US007172314B2

(12) United States Patent
Currie et al.

(10) Patent No.: US 7,172,314 B2
(45) Date of Patent: Feb. 6, 2007

(54) SOLID STATE ELECTRIC LIGHT BULB

(75) Inventors: Robert M. Currie, Dollard-Des-Ormeaux (CA); Eliot Sorella, Laval (CA)

(73) Assignee: Plastic Inventions & Patents, LLC, Saint Laurent (CA)

( * ) Notice: Subject to any disclaimer, the term of this patent is extended or adjusted under 35 U.S.C. 154(b) by 0 days.

(21) Appl. No.: 10/901,026

(22) Filed: Jul. 29, 2004

(65) Prior Publication Data

US 2005/0135098 A1 Jun. 23, 2005

Related U.S. Application Data

(60) Provisional application No. 60/490,441, filed on Jul. 29, 2003, provisional application No. 60/490,445, filed on Jul. 29, 2003.

(51) Int. Cl.
*F21V 11/00* (2006.01)

(52) U.S. Cl. ..... 362/240; 362/243; 362/245; 362/307; 362/800

(58) Field of Classification Search ..... 362/240, 362/307, 800, 243, 245, 246, 650; D26/2
See application file for complete search history.

(56) References Cited

U.S. PATENT DOCUMENTS 4,211,955 A * 7/1980 Ray ..... 362/800
5,642,933 A * 7/1997 Hitora ..... 362/243
5,850,126 A * 12/1998 Kanbar ..... 362/800
6,218,785 B1 * 4/2001 Incerti ..... 362/307

* cited by examiner

*Primary Examiner*—Stephen F Husar
(74) *Attorney, Agent, or Firm*—Merek, Blackmon & Voorhees, LLC

(57) ABSTRACT

A solid state light bulb for attachment to a lamp socket. The light bulb uses a number of super bright LEDs or color LEDs mounted within a hollow housing to replace a standard bulb such as a 60 Watt bulb. A stepped, reverse conical interior wall distributes and diffuses the light to project the appearance of a normal bulb. An upper lens of the housing may be removable to form a spot light effect.

13 Claims, 1 Drawing Sheet

SOLID STATE ELECTRIC LIGHT BULB

CROSS REFERENCE TO RELATED APPLICATIONS

This application claims the benefit of U.S. Provisional Application 60/490,445 filed Jul. 29, 2003, which is hereby incorporated by reference. This application also claims the benefit of U.S. Provisional Application 60/490,441 filed Jul. 29, 2003, which is hereby incorporated by reference.

BACKGROUND OF THE INVENTION

A. Field of the Invention

The present invention relates to a solid state replacement for an electric light bulb.

B. Description of the Prior Art

At the present time conventional American electric light bulbs utilize 115 VAC to generate sufficient electric current through a filament mostly of tungsten to heat the filament until light and heat are emitted. The light from the filament is dispersed through the glass globe in all directions except through the socket. Most economically produced bulbs of this configuration have a finite use life. Bulbs of this type can and are made to last longer than the more economical version but the cost cannot be born by all consumers. A second problem with incandescent bulbs is the temperature of the glass globe when power has been applied to the bulb. Many fingers have been burned trying to remove such a bulb without allowing sufficient time for the bulb to cool down. This present instant invention solves the problem of a finite useful life of incandescent light bulbs and the safety problem of hot bulbs burning fingers and sometimes starting fires.

None of the prior art inventions and patents, taken either singly or in combination, is seen to describe the instant invention as claimed.

SUMMARY OF THE INVENTION

The present invention is accomplished by using new technology and new ideas to create an inventive solid-state electric light bulb that does not require the frequency of replacement of even the very best and most expensive 115 VAC filament type bulbs and at the same time increase safety because the bulb globe does not get hot enough to burn fingers.

The present use of incandescent bulbs requires that have burned out bulbs to be replaced on a regular basis thereby increasing the cost of electric illumination to the consumer and creating a burn hazard for those impatient few who do not allow sufficient cool down time of the bulb before replacement.

The present invention utilizes five super bright solid-state light emitting diodes, either a LumaLED 1.2 watt, 350 milli-amp, 3.5 Volt DC white light LED, or one similar thereto, inside of a five piece optically conductive shell or globe. The solid state LEDs can have all soldered electrical connections and electrically will last indefinitely.

Additionally, the acrylic or plastic globe versions of these unique solid state lighting units are not easily physically damaged and can provide colored light where desirable. Four of the LEDs may be mounted equally spaced around in a circle on the metal surface of the heat shield inside the circumferential perimeter lip or raised rim. A fifth LED is mounted in the exact center. An electrical circuit that rectifies 115-VAC house current and reduces the DC output voltage to that required by the electrical series connection of the multiple LEDs is located in the base of the heat sink beneath the metal surface upon which the LEDs are mounted.

The base of an optically conductive acrylic bulb globe fits onto the heat sink inside of the raised rim and extends approximately three inches to a top diameter preferably 15% smaller than that of the base. Cutting concentric circles into the bulb globe starting at the top hollow out the inside of the bulb globe in a cone shape. Each succeeding cut is smaller in diameter than the first and is connected to the first so that stepped rings form the inside hollow cone shape. The small end of the cone shape is located just above the center mounted LED. The stepped rings of the open internal cone shape create reflecting surfaces within the bulb globe to disperse and diffuse the light from the LEDs out of the bulb globe in any and all directions.

A removable optically conductive lens cap or cover is press fitted, or screw thread attached to cover the opening of the acrylic bulb globe. When electrical power is applied to the LEDs of the bulb and the lens cap or cover is removed, a bright semi-spot light emanates from the bulb globe. This feature is helpful when the bulb is overhead and concentrated illumination is needed below the bulb. A circular heat sink base mount is located between the larger diameter of the base of the heat sink and the smaller top of the bulb socket unit. The long-life solid state LEDs also provides the advantage of less power consumption than incandescent or halogen light sources.

Accordingly, it is a principal object of the invention to use new solid-state illumination technology to make a replacement for the Edison filament electric light bulb.

It is another object of the invention to provide center and perimeter lighting by using perimeter and central LEDs.

It is a further object of the invention to provide a globe lighting effect by providing a central globe around the light sources.

Still another object of the invention is to provide a long life bulb by replacing conventional lighting elements with LEDs.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(s)

Figure 1A:
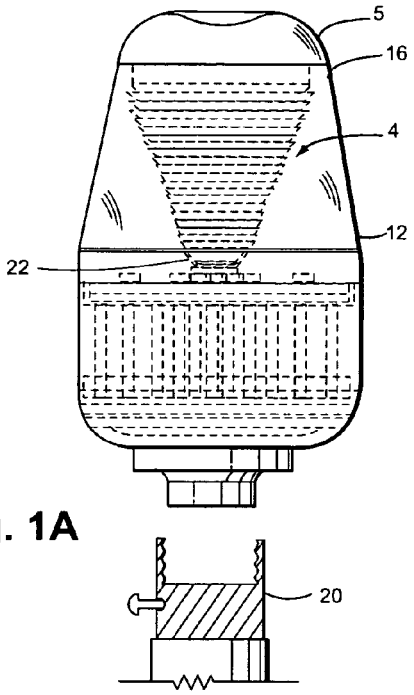
FIG. 1A is an elevational view of a solid state light bulb according to the present invention.
Figure 1B:
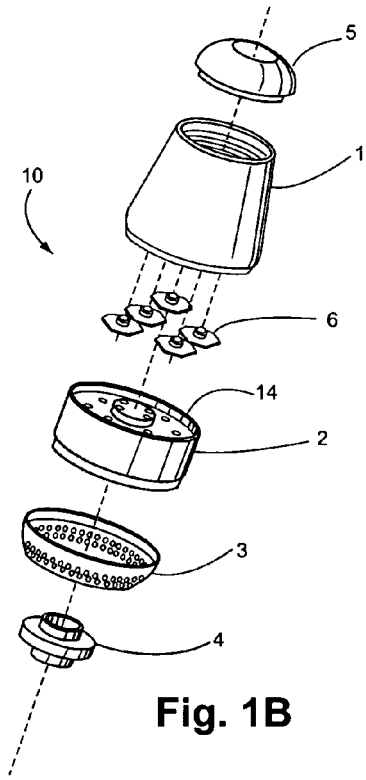
FIG. 1B is an exploded view of the components of the LED light bulb according to the present invention.

The present invention is to a solid-state light bulb which replaces a current electric light bulb. As best shown by reference to the figures, the invention will be disclosed in further detail.

According to the present invention, a solid state light bulb 10 includes a bulb socket 4 is connected to a heat sink base mount 3. The bulb socket 4 preferably is sized and arranged to electrically mate with a lamp socket 20 when the bulb socket 4 is threadedly or otherwise attached to the lamp socket. The lamp socket 20 is preferably a "household lamp socket" which is hereby defined as a conventional lamp socket configured to accept a standard 60 Watt, 120 V light bulb available from Phillips or General Electric.

The heat sink unit 2 includes an integrated AC to DC power supply which is machined to fit snugly into heat sink base mount 3. LEDs 6 may be soldered to DC voltage connections on the upper side of heat sink unit 2. An optically conductive acrylic bulb globe 1 fits into base heat sink unit 2 to cover LEDs 6. A removable optically conductive lens cover 5 is attached to bulb globe unit 1 by press fit or screw threads.

The present invention utilizes five super bright solid-state light emitting diodes 6. The LEDs are preferably LUMALED 1.2 watt, 350 milli-amp, three and one half Volt DC white light LED, or the like. The LEDs are mounted inside of a five-piece optically conductive shell or globe 1. The solid state LEDs preferably include soldered electrical connections for added longevity, however, one skilled in the art would recognize that other means of attaching the LEDs.

The acrylic or plastic globe versions of the solid state lighting unit preferably include colored LEDs, either color LEDs of a fixed color or multicolor LEDs capable of being selectively illuminated in various colors. Alternatively black light LEDs could be used for some or all of the LEDs. Four of the LEDs are preferably mounted equally spaced around in a circle on the metal surface of the heat shield inside the circumferential perimeter lip or raised rim. One skilled in the art would recognize that more or fewer of the LEDs could be mounted around the perimeter to raise or lower the overall power rating of the bulb to simulate for instance a 60 W bulb, a 40 W bulb, a 75 W bulb, etc. These perimeter LEDs may be multicolor LEDs which may be used to provide decorative lighting when direct utility lighting (i.e., for reading, etc.) is not needed. The LEDs may also be UV LEDs to provide "black lighting" effects. However, for normal use, preferably all of the LEDs are bright white.

A fifth LED 22 is mounted in substantially the exact center. The LED may be multicolor, but is preferably a bright white LED. A removable optically conductive lens cap or cover 5 is press fitted, or screw thread attached to cover the opening of the acrylic bulb globe. When electrical power is applied to the LEDs of the bulb and the lens cap or cover is removed, a bright semi-spot light emanates from the bulb globe. This feature is helpful when the bulb is overhead and concentrated illumination is needed below the bulb. A circular heat sink base mount is located between the larger diameter of the base of the heat sink and the smaller top of the bulb socket unit to dissipate heat from the first LED.

An electrical circuit that rectifies 115-VAC house current and reduces the DC output voltage to that required by the electrical series connection of the multiple LEDs is located in the base of the heat sink beneath the metal surface upon which the LEDs are mounted.

The base 12 of the optically conductive acrylic bulb globe fits onto the heat sink 2 inside of the raised rim 14 and extends preferably three inches to a top diameter 16 preferably 15% smaller than that of the base. The top of the bulb is capped by lens 5 as discussed above.

The interior of the bulb is preferably formed by cutting concentric circles 18 into the bulb globe starting at the top hollow on the inside of the bulb globe to form a cone shape opposite that of the globe outer wall. Each succeeding cut is smaller in diameter than the first and is connected to the first so that stepped rings form the inside hollow cone shape. The small end of the cone shape is located just above the center mounted LED 22. The stepped rings of the open internal cone shape create reflecting surfaces within the bulb globe to disperse and diffuse the light from the LEDs out of the bulb globe into any and all directions to simulate a standard bulb. The long-life solid state LEDs there provides all of the advantages of a standard bulb, with the further advantage of less power consumption than incandescent or halogen light sources.

It is to be understood that the present invention is not limited to the sole embodiment described above, but encompasses any and all embodiments within the scope of the following claims.

We claim:

1. A solid state light bulb mountable on a household lamp socket, comprising:

a bulb socket for electrically connecting said solid state light bulb to the household lamp socket;

a base having at least one light emitting diode ("LED") electrically connected to said bulb socket;

a diffuser surrounding at least a portion of said at least one LED for diffusing light from said LEDs;

said diffuser having a translucent outer wall and a substantially conical inner wall; and said conical inner wall having a plurality of stepped, concentric rings forming said conical inner wall, each said concentric ring having an outer face angled to reflect light from said at least one LED substantially radially outward from said concentric ring;

an end cap attached at a distal end of said diffuser from said base for defining a light passage way within said inner conical wall;

wherein said end cap is a lens for focusing light in said light passage way to a remote location.

2. The solid state light bulb of claim 1, further comprising:

a converter for converting AC current of the household lamp socket to DC prior to powering said at least one LED;

a step down transformer for converting the voltage of the household lamp socket to drive said at least one LED; and a central housing for housing said transformer and said converter.

3. The solid state light bulb of claim 1, wherein said substantially conical inner wall extending the entire length of the diffuser from the center of said base to said distal end of the diffuser.

4. A solid state light bulb mountable on a household lamp socket, comprising:

a bulb socket for electrically connecting said solid state light bulb to the household lamp socket;

a base having at least one light emitting diode ("LED") electrically connected to said bulb socket;

a diffuser surrounding at least a portion of said at least one LED for diffusing light from said LEDs;

said diffuser having a translucent outer wall and a substantially conical inner wall; and said stepped inner wall having a plurality of stepped, concentric rings forming said conical inner wall, each said concentric ring having an outer face angled to reflect light from said at least one LED substantially radially outward from said concentric ring;

wherein said end cap is a diffuser cap for diffusing axially directed light from said LED outwardly to provide uniform lighting throughout the illuminated portion of said solid state bulb.

5. A solid state light bulb mountable on a household lamp socket, comprising:

a bulb socket for electrically connecting said solid state light bulb to the household lamp socket;

a plurality of light emitting diodes ("LEDs") electrically connected to said bulb socket;

a diffuser surrounding at least a portion of said LEDs for diffusing light from said LEDs;

said diffuser having a translucent outer wall and defining a substantially conical inner wall extending the entire length of the diffuser;

an end cap attached at a distal end of said diffuser from said base for defining a light passage way within said inner conical wall.

wherein said end cap is a lens for focusing light in said light passage way to a remote location.

6. The solid state light bulb of claim 5, further comprising:

a converter for converting AC current of the household lamp socket to DC prior to powering said at least one LED;

a step down transformer for converting the voltage of the household lamp socket to drive said at least one LED; and a central housing for housing said transformer and said converter.

7. The solid state light bulb of claim 5, wherein said conical inner wall has a plurality of stepped, concentric rings forming said conical inner wall, each said concentric ring has an outer face angled to reflect light from said at least one LED substantially radially outward from said concentric ring.

8. A solid state light bulb mountable on a household lamp socket, comprising:

a bulb socket for electrically connecting said solid state light bulb to the household lamp socket;

a plurality of light emitting diodes ("LEDs") electrically connected to said bulb socket;

a diffuser surrounding at least a portion of said LEDs for diffusing light from said LEDs;

said diffuser having a translucent outer wall and defining a substantially conical inner wall extending the entire length of the diffuser;

an end cap attached to the distal end of said diffuser from said base for defining a light passage way within said inner conical wall.

wherein said end cap is a diffuser cap for diffusing axially directed light from said LED outwardly to provide uniform lighting throughout the illuminated portion of said solid state bulb.

9. A solid state light bulb mountable on a household lamp socket, comprising:

a bulb socket for electrically connecting said solid state light bulb to the household lamp socket;

a plurality of light emitting diodes ("LEDs") electrically connected to said bulb socket;

a diffuser surrounding at least a portion of said LEDs for diffusing light from said LEDs;

said diffuser having a translucent outer wall and a substantially conical inner wall defining an interior light passage way; and an end cap attached to said diffuser and enclosing said interior light passage way;

wherein said end cap is removable for focusing non-diffused light from the bulb on a remote location.

10. The solid state light bulb of claim 9, further comprising:

a converter for converting AC current of the household lamp socket to DC prior to powering said at least one LED;

a step down transformer for converting the voltage of the household lamp socket to drive said at least one LED; and a central housing for housing said transformer and said converter.

11. The solid state light bulb of claim 9, wherein said substantially conical inner wall extending the entire length of the diffuser from the center of said base to said distal end of the diffuser.

12. The solid state light bulb of claim 9, wherein said end cap is a lens for focusing light in said light passage way to a remote location.

13. The solid state light bulb of claim 9, wherein said end cap is a diffuser cap for diffusing axially directed light from said LED outwardly to provide uniform lighting throughout the illuminated portion of said solid state bulb.

* * * * *